US008275847B2

(12) United States Patent
Lewis

(10) Patent No.: US 8,275,847 B2
(45) Date of Patent: Sep. 25, 2012

(54) INTERACTIVE MAINTENANCE MANAGEMENT ALARM HANDLING

(75) Inventor: Michael W. Lewis, Tucson, AZ (US)

(73) Assignee: Modular Mining Systems, Inc., Tucson, AZ (US)

( * ) Notice: Subject to any disclaimer, the term of this patent is extended or adjusted under 35 U.S.C. 154(b) by 1861 days.

(21) Appl. No.: 11/108,420

(22) Filed: Apr. 18, 2005

(65) Prior Publication Data

US 2005/0179537 A1 Aug. 18, 2005

Related U.S. Application Data

(63) Continuation-in-part of application No. 10/641,842, filed on Aug. 15, 2003, now abandoned.

(51) Int. Cl.
*G06F 15/16* (2006.01)

(52) U.S. Cl. ..... 709/207

(58) Field of Classification Search ..... 709/207
See application file for complete search history.

(56) References Cited

U.S. PATENT DOCUMENTS

| | | | | |
|---|---|---|---|---|
| 5,327,347 | A * | 7/1994 | Hagenbuch | 701/50 |
| 5,977,871 | A | 11/1999 | Miller et al. | |
| 6,385,609 | B1 | 5/2002 | Barshefsky et al. | |
| 6,654,803 | B1 | 11/2003 | Rochford et al. | |
| 6,684,265 | B2 * | 1/2004 | Graf | 710/18 |
| 6,965,309 | B1 * | 11/2005 | Bleznyk et al. | 340/521 |
| 2002/0113877 | A1 | 8/2002 | Welch | |

* cited by examiner

*Primary Examiner* — Hussein Elchanti
*Assistant Examiner* — Maceeh Anwari
(74) *Attorney, Agent, or Firm* — Quarles & Brady LLP

(57) ABSTRACT

An Interactive Maintenance Management System ("IMMS") (10) is an alarm handling system (FIG. 2) for handling alarms (102) that indicate present or imminent equipment failure. The IMMS (10) may be utilized in industrial situations, such as strip-mines (14), to reduce equipment (12) downtime and reduce or prevent equipment failure. The IMMS (10) utilizes a flexible response system to track, analyze, and improve performance of the alarm handling system.

17 Claims, 15 Drawing Sheets

INTERACTIVE MAINTENANCE MANAGEMENT ALARM HANDLING

RELATED APPLICATIONS

This application is a continuation-in-part of U.S. patent application Ser. No. 10/641,842, filed on Aug. 15, 2003.

BACKGROUND OF THE INVENTION

1. Field of the Invention

This invention is related in general to the field of maintenance management systems. In particular, the invention comprises utilizing a set of procedures for addressing maintenance issues.

2. Description of the Prior Art

In many industries, such as strip-mining activities, it is common to use heavy equipment to facilitate acquiring, moving, and placing large and heavy items. In the strip-mining industry, heavy equipment may include dozers, drills, haul trucks, loaders, and shovels.

A dozer is a tracked or wheeled piece of equipment that moves earth with a large blade to clear or level areas. A drill is another tracked piece of equipment utilized to create holes, usually for the placement of explosives, utilizing rotation or percussion. Haul trucks carry waste and ore material between locations at the mine site. Often, these trucks operate in a cycle of loading, hauling, dumping, and returning for the next load. Loaders are rubber-tired pieces of equipment used to move rock and load trucks. Shovels are similar to loaders, however they are usually larger and are tracked vehicles. Shovels are generally either powered by diesel engines or large electric motors.

Strip-mines and similar industrial locations are stressful environments for these heavy pieces of equipment. Some equipment, such as drills, may experience extreme use resulting in severe stress and strain on both static components (frames, superstructure, and undercarriage) and moving parts (engines, motors, gears, shafts, and hoses). The mine can be a very hostile environment for all equipment. There are severe loading issues for all mine equipment. Other equipment, such as haul trucks, may be utilized in a near-constant cycle (load, haul, dump, return) that results in steady and persistent wear in some components and unpredictable wear in other components. Temperatures in these environments may also be extreme and can vary greatly over a period of hours or months. There are numerous reasons that equipment breaks down. Some of the principal reasons include, use of equipment beyond its design, operator abuse, poor design, manufacturer defects, poor or incorrect maintenance, wear-out, accident, etcetera. Dust and dirt can also accumulate on moving parts and result in excessive and premature wear. Impurities, including water, fuel, dust, and dirt, may be inadvertently introduced into lubricating fluids, resulting in additional wear.

This wear on both static and dynamic parts often leads to failure of an equipment component. Failure is characterize by the termination of the ability of the equipment to perform its required function to a set standard. Failure results in downtime, which is calculated as the measurement of time the equipment is unavailable to fulfill its performance requirements divided by its intended utilization period.

Because the cost of heavy equipment is very high, any downtime decreases the return on investment for the associated equipment. The impact of a failure may be higher in hidden costs (i.e. production losses) than the actual repair capital costs of the equipment. An equipment's reliability is measured as a probability that it will perform satisfactory for a given period of time, under specified operating conditions, and its mean time between failure ("MTBF") is a measure of its uptime (the opposite of downtime) in a given period of time divided by the number of failures in that time period. For these reasons, downtime is carefully tracked and extraordinary measures are employed to prevent or minimize it, as much as possible.

Maintenance activities are performed to ensure equipment performs its intended function, or to repair equipment which has failed. Preventive maintenance entails servicing equipment before it has failed by replacing, overhauling, or remanufacturing components at fixed intervals, regardless of their condition. Periodic maintenance, such as scheduled replacement of components or lubricants, is performed at regular intervals based on either use or time.

Predictive maintenance is a strategy based on measuring the condition of equipment in order to assess whether it will fail during some future period, and then taking appropriate action to either prevent the failure or make allowance for the anticipated equipment downtime. One method of implementing predictive maintenance is termed Oil Analysis, whereby lubricants (including hydraulic fluid and engine oil) are sampled and subjected to a variety of tests. These tests are designed to identify contaminants, such as water, fuel, and dust, and measure lubricant viscosity.

Data from a piece of equipment may be transmitted from the field to the maintenance office or to a service center or off-site original equipment manufacturer ("OEM") facility for analysis, referred to as remote condition monitoring. Remote condition monitoring may be utilized for failure reporting, or to report the status of the equipment such as time-in-use or lubricant levels. Another method of maintenance planning is to employ trend analysis, whereby predictive maintenance tools analyze the equipment=s operating conditions and estimate the potential wear and failure cycle of the equipment. These preventative and predictive maintenance programs are designed to facilitate the implementation of planned maintenance, whereby maintenance tasks are organized to ensure they are executed to incur the least amount of downtime at the lowest possible cost.

The effectiveness of these maintenance strategies is measured by the mean time between failure ("MTBF"), the equipment uptime divided by the number of failures in a particular period of time. Another measurement tool of maintenance effectiveness is the mean time to repair ("MTTR"). However, the MTTR can be influenced by additional factors, such as failure response time, spare parts availability, training, location, and weather. Once a failure has occurred, failure analysis may be performed to determine the root cause of the failure, develop improvements, and eliminate or reduce the occurrence of future failures.

Maintenance tasks are generally managed through the use of work orders, documents including information such as description of work, priority of work, job procedure, and parts, material, tools, and equipment necessary to complete either a preventative maintenance or repair task. Work order requests are proposals to open work orders and submitted to persons authorized to generate work orders.

Once a failure has occurred, or is eminent, a piece of equipment may generate an alarm or an indication that the equipment is being utilized outside its operating profile. Alarms and indications may be generated by on-board sensors, OEM monitoring systems, or trend analysis. Additionally, equipment operators and maintenance technicians may initiate an alarm or notification during an operational pre-inspection or based on equipment performance. If an operator does not have the authority to issue an alarm or notification, the condition may be communicated to a maintenance analyst, who, in turn, generates an alarm or notification.

The problem with the current state of alarm handling is that alarms are not handled in an organized manner or, in many cases, not at all. Alarms may not be discovered until failure because there is no formal process for handling the alarms, and if there is a process for reviewing this information they are typically ineffective because of the large number of alarm events. After problem identification, there are often several different procedures in place to handle them. The response to an alarm will often include different people who apply their own methods for handling it. This leads to an inconsistency in how the alarm is handled and a corresponding degradation in the efficiency and effectiveness of the alarm handling process. Therefore, it is desirable to provide a consistent, effective, and efficient method for handling alarms, indications, and notifications which can be tracked, measured, and improved upon.

SUMMARY OF THE INVENTION

This invention is based on utilizing an Interactive Maintenance Management System ("IMMS") to establish a procedure for handling each alarm, indication, and notification that occurs. For the purposes of this application, an alarm is a notification of a problem or abnormal event. The alarm handling procedure begins at the piece of heavy equipment ("Equipment"), when the alarm is generated, and continues through the workflow timeline of the maintenance department, until the cause of the alarm has been addressed. All alarms which are generated will be handled by this system. Variations in the maintenance management process may be dictated by the severity of the associated alarm.

Once an alarm has been generated, it is transmitted from the equipment to a central computer over a communications network, such as a site-wide radio network. The central computer analyzes the received alarm and establishes a Priority based on the severity of the alarm. The alarm is routed to the appropriate responsible maintenance personnel, if required.

Some routed alarms require a response from the appropriate maintenance personnel. If so, the IMMS will wait for an acknowledgment. If no acknowledgment is received, the IMMS will forward the alarm to the next person on a notification list. Once an alarm has been received by a maintenance personnel, he analyzes any supporting information to determine whether the alarm is valid. If the alarm is determined to be invalid, it is either managed or dismissed. Alternatively, this may be done by a computerized routine.

In one scenario, once an alarm has been determined to be valid, a plan of action ("Plan") is generated and the sent to a responsible Supervisor, along with the alarm and supporting information. The supervisor then assigns and forwards the Plan to a maintenance technician who then completes the necessary work.

One aspect of this invention is a method of maintaining and repairing Equipment in an efficient and cost-effective manner utilizing algorithms. Another aspect of the invention is to provide a means for tracking, measuring and improving the maintenance management system. It is still another objective to provide a maintenance system in which generated alarms are not ignored, overlooked, or misplaced. Additionally, the most severe alarms should be addressed first in an expeditious manner.

Various other purposes and advantages of the invention will become clear from its description in the specification that follows and from the novel features particularly pointed out in the appended claims. Therefore, to the accomplishment of the objectives described above, this invention comprises the features hereinafter illustrated in the drawings, fully described in the detailed description of the preferred embodiments and particularly pointed out in the claims. However, such drawings and description disclose just a few of the various ways in which the invention may be practiced.

BRIEF DESCRIPTION OF THE DRAWINGS

FIG. 2(B) is a flow chart illustrating the second variation of the analysis process step, indicated in FIG. 2.

DESCRIPTION OF THE PREFERRED EMBODIMENTS

Figure 1:
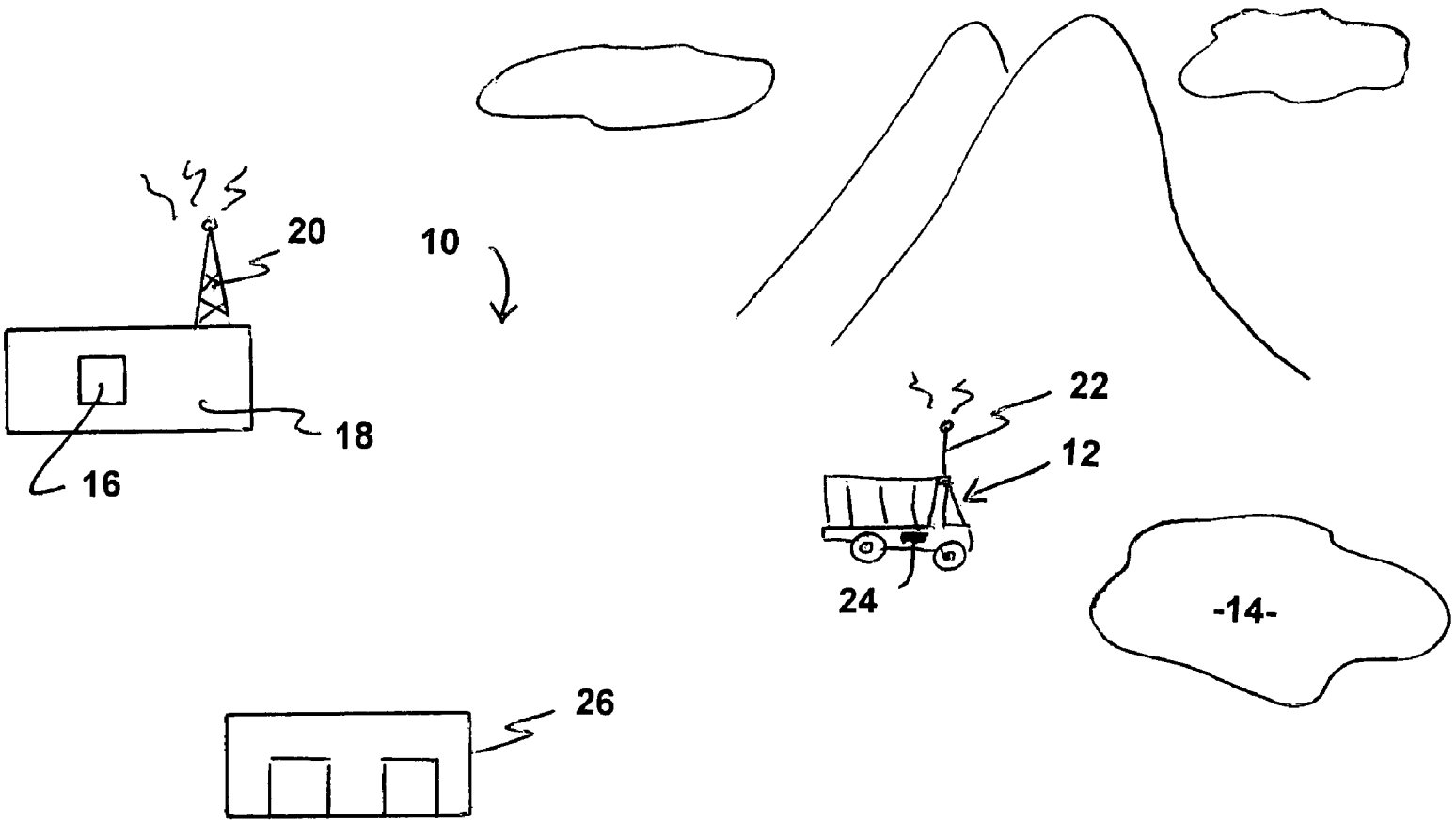
FIG. 1 is an illustration of an overview of the Interactive Maintenance Management System ("IMMS"), according to the invention.

As a general overview of the invention, FIG. 1 shows an Interactive Maintenance Management System ("IMMS") 10. A piece of heavy equipment 12 is located at a strip mine 14. A central computer 16 is located at a central office 18, along with a transceiver 20 of the communications network. Another transceiver 22 is located at each piece of equipment 12. Additionally, an alarm generator 24 is located on the equipment 12. Additionally, a maintenance department 26 is provided as a location for servicing and repairing the equipment 12.

Numerous technical and administrative positions are necessary to facilitate the operation of the IMMS. The equipment operator can be a key part of the condition monitoring and alarm generation system, in that he can detect equipment deterioration and abnormal conditions which are not detected by on-board sensors. A maintenance dispatcher is the person responsible for ensuring good communication between maintenance and administrative personnel. Equipment problems are communicated to the maintenance dispatcher and he, in turn, passes the information to the shop maintenance supervisor, typically over voice radio. When the shop maintenance supervisor verifies that a repair has been completed, he informs the maintenance dispatcher that the equipment is no longer down. The responsibilities of the maintenance dispatcher may alternatively be handled by an operations dispatcher, or a secondary operations dispatcher, depending on the size of the mining operation and its operational configuration.

In the preferred embodiment of the invention, alarms (notifications of problems or abnormal events) may be categorized at one of three different priority levels. The highest level of alarm, level 1, is typically associated with equipment which is experiencing downtime. Additionally, this alarm level may indicate a problem which raises safety concerns or may lead to potential equipment damage. Level 2 alarms are those generated when equipment may be functioning, but prolonged use may result in component failure. Nuisance alarms are considered level 3 and represented those which may be disregarded. An example of a level 3 Alarm is one generated by a faulty sensor.

A key person in the efficient operation of the IMMS is the maintenance assistant. It is his role to analyze alarms, establish an alarm priority and recommend a job action plan. Additionally, the maintenance assistant ensures that appropriate supporting information is passed on with the alarm.

The shop maintenance supervisor prioritizes and assigns tasks to shop maintenance technicians who, in turn, affect the actual repair of the equipment, once it has been delivered to the maintenance department 26. Shop maintenance technicians perform scheduled repairs, such as oil changes and engine overhauls, and unplanned maintenance due to equipment failure.

Some repairs do not require the facilities of the maintenance department 26. Additionally, in some circumstances, equipment which is experiencing a failure may not be able to be moved to the maintenance department. In those circumstances, a field maintenance technician performs unplanned repairs and service on-site. These field maintenance technicians generally visit the maintenance department only to get parts, material, tools, and equipment necessary to effect repairs on the equipment.

The field maintenance supervisor prioritizes and assigns the job repairs tasks to the field maintenance technicians. Additionally, they coordinate activities with the maintenance dispatcher and shop maintenance supervisor.

The maintenance department is supported by a team of administrative and engineering staff. The maintenance analyst researches all available data, including equipment history, trend data, and real-time data, to handle level 2 alarms that are non-critical. These problems generally require a more careful and long-term troubleshooting approach, as these problems are generally not as straightforward and obvious as those generating level 1 alarms. One responsibility of the maintenance analyst is to identify trends or re-occurring problems.

The maintenance engineer is responsible for developing maintenance programs and supporting the day-to-day engineering needs of the maintenance department. Their job requires extensive use of remote condition monitoring and a review of maintenance history. Maintenance planners are responsible for short and long-term planning of maintenance tasks. It is the responsibility of the planners to schedule planned maintenance. Overseeing the IMMS is the maintenance superintendent. It is his/her job to establish the goals of the maintenance department and evaluate the effectiveness of the IMMS.

Figure 2:
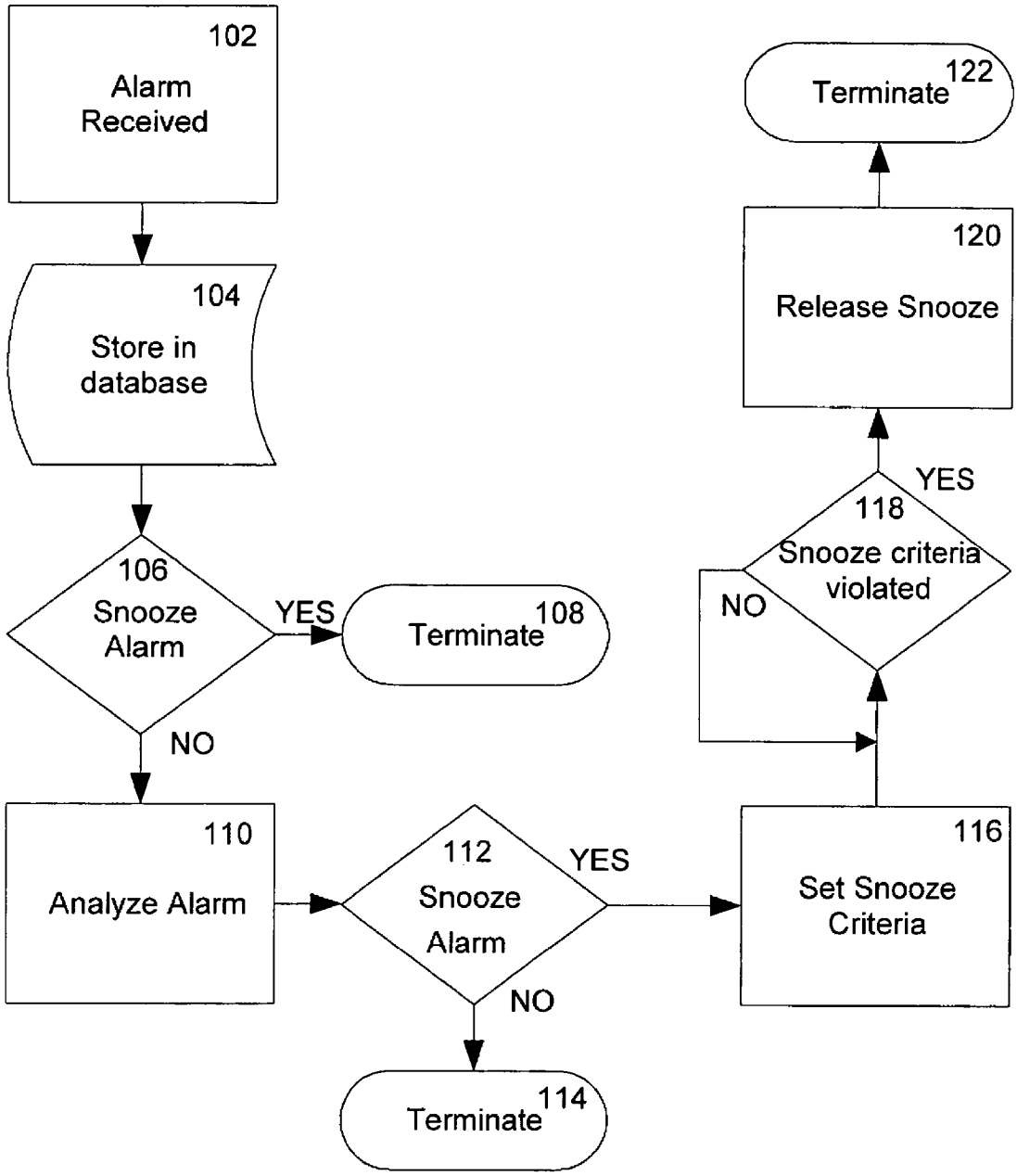
FIG. 2 is a flow chart illustrating an overview of the method of alarm Handling, according to the invention.

An overview of the operation of the IMMS 10 is illustrated in the flow-chart of FIG. 2. Initially, an alarm is received 102 at the central office 18 by the central computer 16. Alarms may be generated in numerous ways. The first is a signal originating from the alarm generator 24, located on the equipment 12. An onboard monitoring system generates an alarm based on an abnormal event occurring on the equipment. Alternatively, an embedded device, programmable logic controller ("PLC"), or other computerized system monitors equipment operating and/or production parameters from one or more sensor or monitoring system. Production parameters from mine management systems would include data such as excavation records (i.e. equipment id, operator id, location, activity times, payload, material type, material characteristics, etcetera), dump records (equipment id, operator id, location, activity times, payload, material type, material characteristics, etcetera), equipment status time (i.e. ready time, delay time, standby time, breakdown time, etcetera). When one or more parameters exceeds an established threshold, an alarm is generated.

Additionally, alarms may be generated utilizing off-board computer based on sensory input from OEM monitoring systems, third-party monitoring systems, sensors, data acquisition systems, supervisory control and data acquisition (SCADA) production data from mine management systems, maintenance history from work order management system, and health information from predictive maintenance database based on fixed or configurable single parameter or multi-parameter thresholds. Various third-party predictive maintenance technology suppliers store their data in a database or other electronic medium. Predictive maintenance technology includes areas such as vibration analysis, fluids analysis (i.e. oil analysis), ultrasonic analysis, ultrasonic testing, infrared analysis, eddy current analysis, mag-particle analysis, etcetera. Another means for generating an Alarm is through the use of remote condition monitoring. Additionally, maintenance or operational personnel may enter the alarm directly into the central computer 16, based on input from equipment operators, field maintenance technicians, or pre-shift inspections. Yet another method of generating alarms is through the use of enterprise resource planning ("ERP") systems. ERPs are integrated information system that serve all departments within an enterprise. Evolving out of the manufacturing industry, ERP implies the use of packaged software rather than proprietary software written by or for one customer. ERP modules may be able to interface with an organization's own software with varying degrees of effort, and depending on the software, ERP modules may be alterable via the vendor's proprietary tools as well as proprietary or standard programming languages. An ERP system can include software for manufacturing, order entry, accounts receivable and payable, general ledger, purchasing, warehousing, transportation and human resources.

Alarms are received as data packets, e.g., a block of data used for transmission in packet-switched systems. Once an alarm has been received 102, the event that generated the alarm and associated information is stored in database 104. Data such as time, date, an abnormal event identifier, equipment identifier, location, equipment operator, operational status, action, alarm snapshot, and production information may be stored in a database along with the alarm. Once the alarm has been stored in the database, the alarm is examined to determine whether the alarm should be snoozed in step 106. Here, snoozing an alarm indicates that the alarm notification is temporarily turned off, pending attention at a later time. Once an alarm is snoozed, a status identifier of the alarm is set to "snoozed." If the status of the alarm is "snoozed," the IMMS algorithm is terminated in step 108, if not the algorithm proceeds to the analysis process in step 110. Either an analyst or a computational routine validates the alarm and determines an appropriate response to the event. The analysis process 110 can be simple or complex and is examined in more detail below.

The next step of the process is to snooze alarm in step 112. In this phase, a logical operator determines if the alarm requires snoozing or should be prevented from entering the analysis process 110. A logical operator represents a decision process wherein a condition is evaluated for true (yes) and false (no). Traditional boolean logical operators can be used in the evaluation (and, or, xor, not, etcetera). If snoozing of the alarm is not necessary, the algorithm terminates in step 114, else notification of the event is suppressed until such time as the snooze criteria are violated. In set snooze criteria 116, the alarm is snoozed based on such factors as time, occurrence frequency, minimum allowable system or component health factors, predefined events, minimum allowable system or component health factor, and other user definable criteria. A minimum allowable system or component health factor is the minimum level of which a system or component is still considered in good health. The factor may be based on a single parameter or a compilation of multiple parameters from various sources. Sources of parameters include OEM monitoring systems, predictive databases, mine management systems, ERP, SCADA, etcetera. The factor is established either by pre-set configurations or manually be the user.

The next evaluation is whether snooze criteria has been violated in step 118. Another logical operator evaluates whether the snooze criteria have been violated and, if so, advances the algorithm to snooze released in step 120. Violations of the snooze criteria is based on factors such as time, occurrence frequency, minimum allowable system or component health factor, predefine event (i.e. completion of repair, component change-out, etcetera), and user defined criteria. The algorithm then terminates in step 122.

Figure 2A:
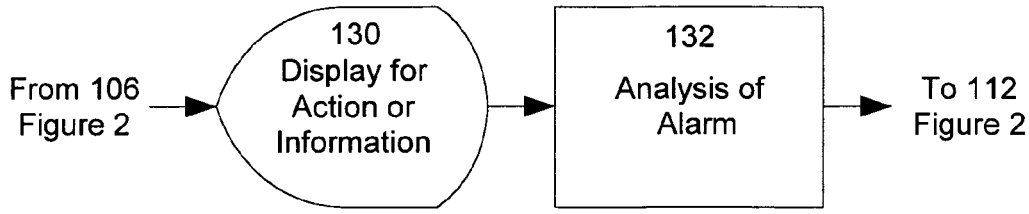
FIG. 2(A) is a flow chart illustrating the first variation of the analysis process step, indicated in FIG. 2.
Figure 2:
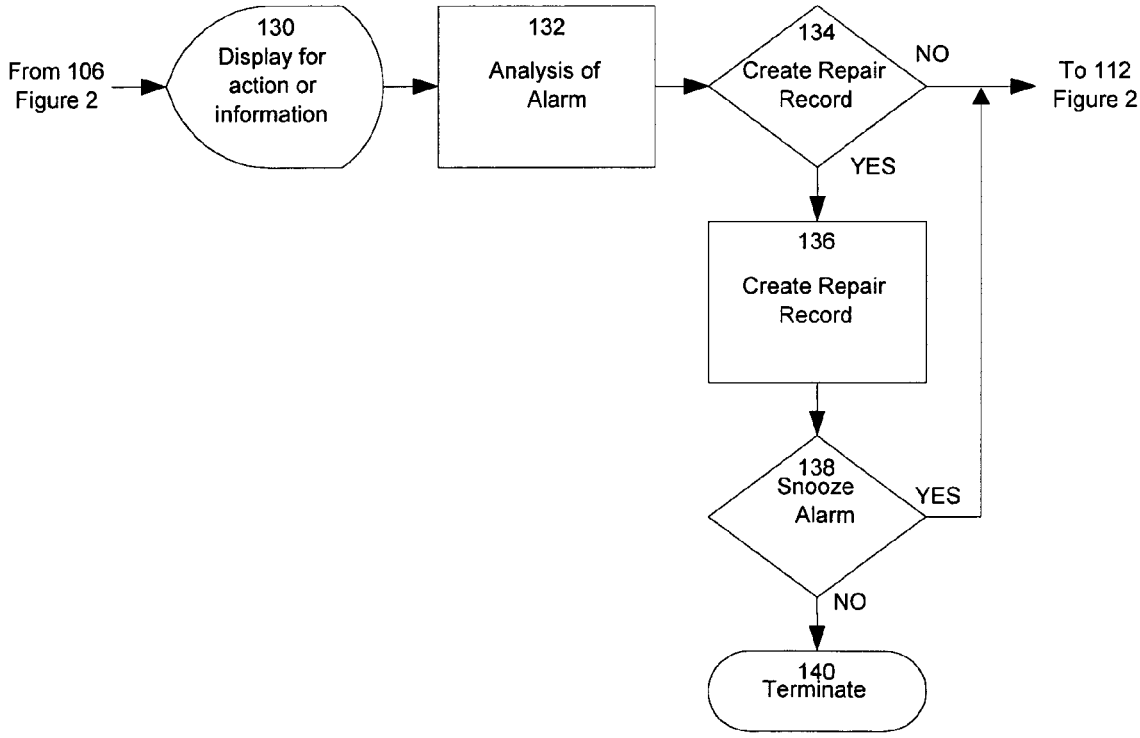

FIG. 2(A) illustrates the optional step of display for action or information 130, followed by the analysis of alarm 132. The alarm is displayed in a common job queue or sent directly to one or more individuals. Individuals are defined in the distribution list for that event. Analysis 132 is the process of validating the alarm and, either through analysis or the utilization of a computational routine, determining the appropriate action. The algorithm illustrated in FIG. 2(B) builds on these steps by adding the create repair record 134 decision point, the create repair record 136 action, the snooze alarm 138, and the terminate 140 action. In the create repair record 134 decision point, a logical operator evaluates whether the alarm includes the criteria for creation of a repair record. Is so, the algorithm returns to step 112 of FIG. 1. The criteria for creation of a repair record may be related to consequences of failure (potential repair costs, production losses, or safety implications if the system goes to failure), availability of maintenance personnel, availability of facilities, production requirements, planned maintenance activities, confidence in diagnosis of problem, parts availability, etcetera. The criteria may be evaluated manually or through a computerized routine. A repair record is created in step 136. A logical operator then evaluates whether the alarm meets the criteria to be snoozed. Is so, the algorithm returns to step 112 of FIG. 1, else the algorithm terminates 140.

Figure 2C:
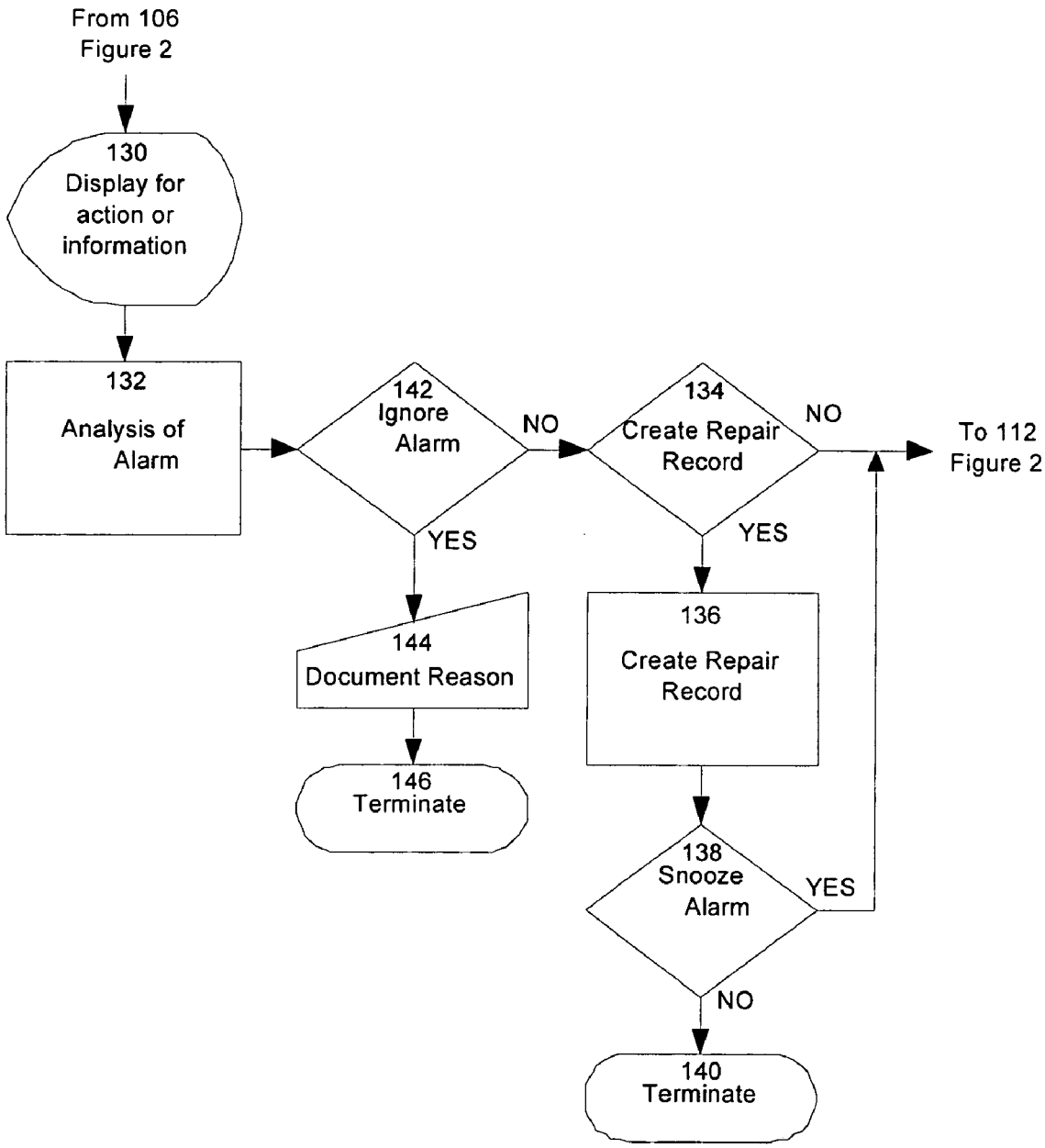
FIG. 2(C) is a flow chart illustrating the third variation of the analysis process step, indicated in FIG. 2.
Figure 2D:
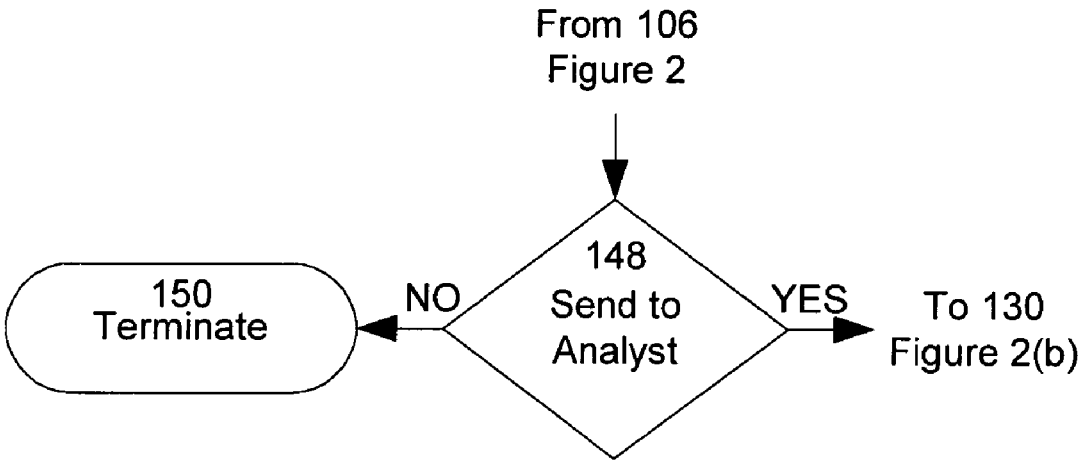
FIG. 2(D) is a flow chart illustrating the fourth variation of the analysis process step, indicated in FIG. 2.
Figure 2E:
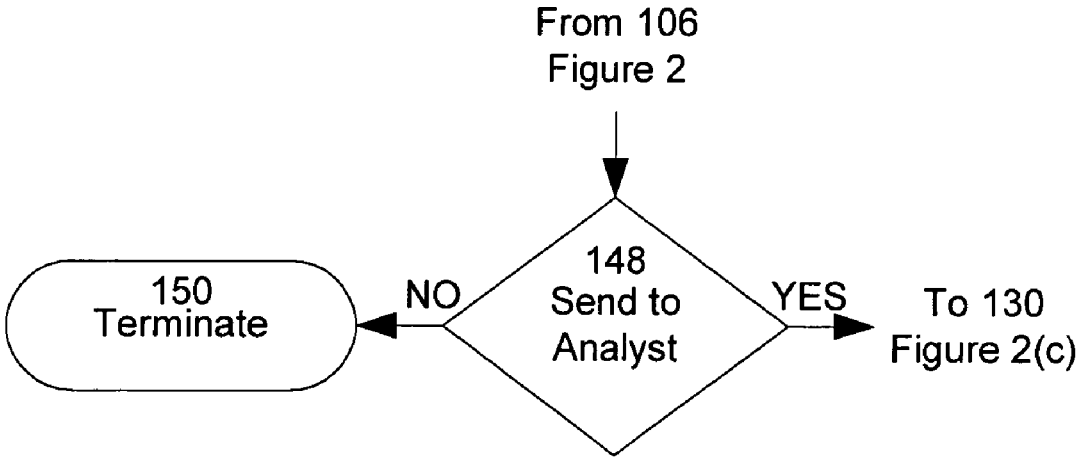
FIG. 2(E) is a flow chart illustrating the fifth variation of the analysis process step, indicated in FIG. 2.

A third variation of the analysis process 110 is illustrated in FIG. 2(C). After the analysis of alarm 132, the decision point of ignore alarm 142 is encountered, wherein a logical operator evaluates whether the alarm meets the criteria to be ignored. If so, the algorithm advances to the documentation reason 144 action, wherein the user enters the appropriate information to document why the alarm is being ignored, and then terminates 146. If not, the algorithm advances to the create repair record 134 decision point, the create repair record 136 action, the snooze alarm 138, and the terminate action of step 140. FIG. 2(D) is a fourth variation of the analysis process 110. The send to analyst 148 decision point is evaluated by a logical operator to determine whether the alarm should be sent to an Analyst. If not, the algorithm terminates 150, else returns to step 130 of FIG. 2(B). In FIG. 2(E), the output of the send to analyst 148 decision point is sent to step 130 of FIG. 2(C).

Figure 2F:
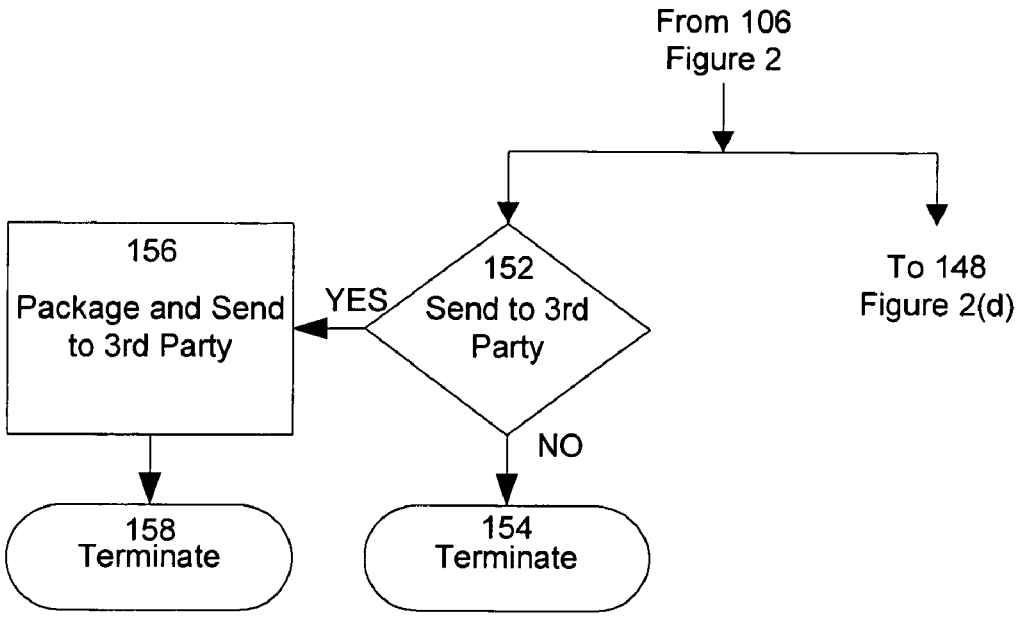
FIG. 2(F) is a flow chart illustrating the sixth variation of the analysis process step, indicated in FIG. 2.
Figure 2G:
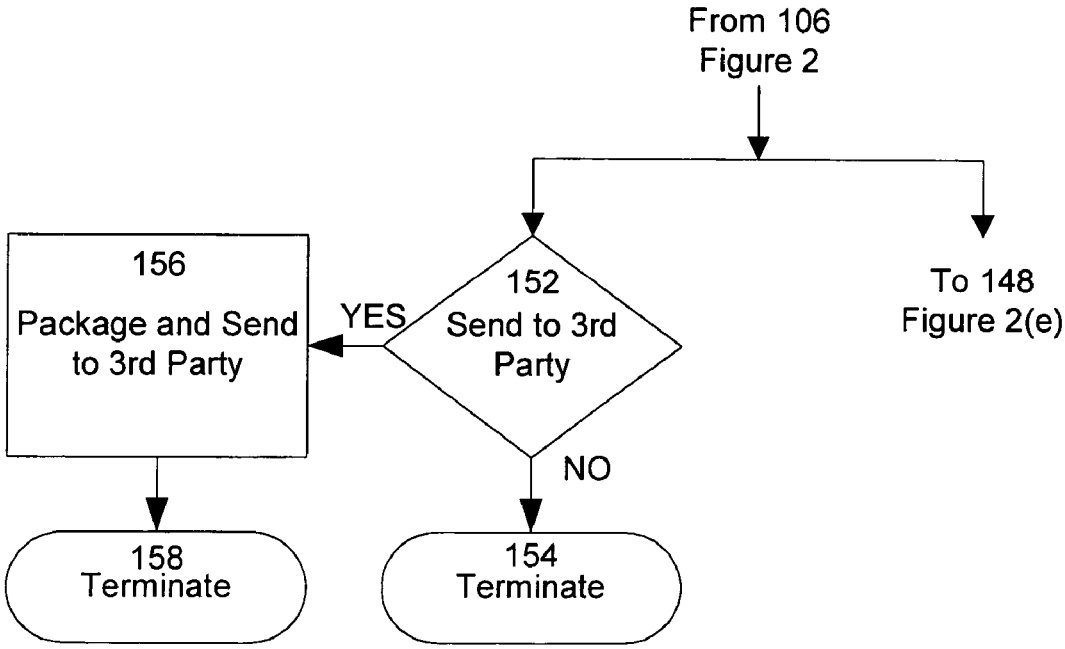
FIG. 2(G) is a flow chart illustrating the seventh variation of the analysis process step, indicated in FIG. 2.

In FIG. 2(F), the algorithm is sent to step 148 of FIG. 2(D) and the send to third party 152 decision point, where a logical operator evaluates whether notification of the alarm should be sent to third party outside maintenance organizations such as OEMs, distributors, solutions centers, or predictive maintenance contractors. Solutions centers is a generic name for an outside organization that provides a mix of consulting or analysis services. In this case, the solution center would receive a packet of data concerning an abnormal event, analyze the data, and provide feedback if required. If so, this branch of the algorithm enters the package and send to third party 156 action step and terminates 158. The algorithm of FIG. 2(G) is similar to that of FIG. 2(F) with the algorithm being sent to step 148 of FIG. 2(E).

Figure 3A:
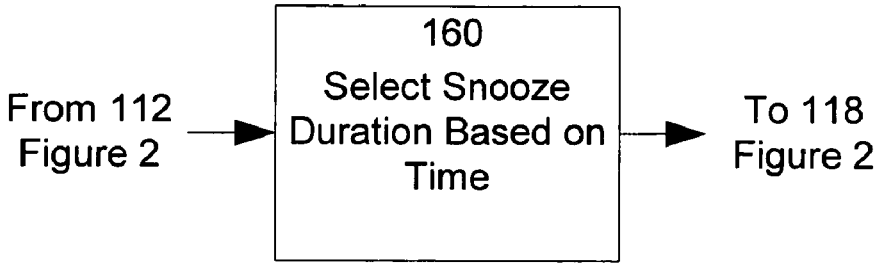
FIG. 3(A) is a flow chart illustrating the first variation of the set snooze criteria action, indicated in FIG. 2.
Figure 3B:
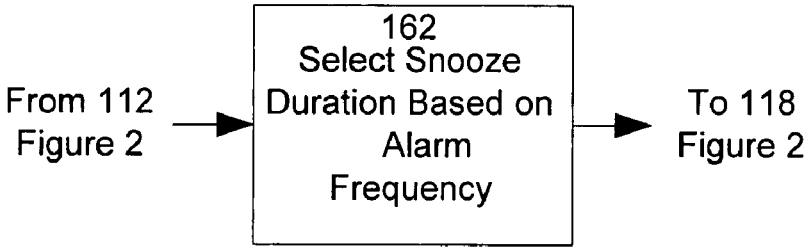
FIG. 3(B) is a flow chart illustrating the second variation of the set snooze criteria action, indicated in FIG. 2
Figure 3C:
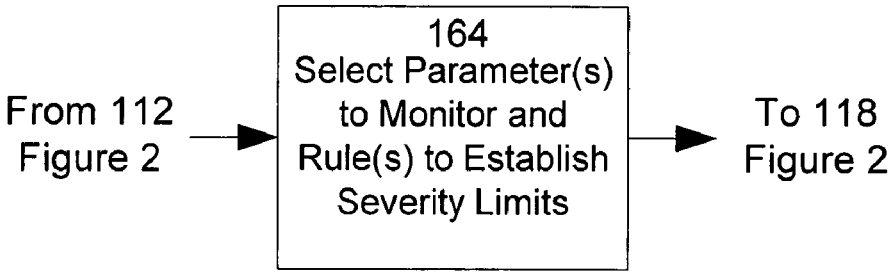
FIG. 3(C) is a flow chart illustrating the third variation of the set snooze criteria action, indicated in FIG. 2
Figure 3D:
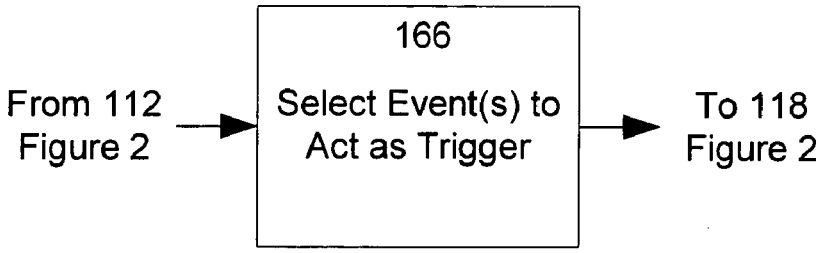
FIG. 3(D) is a flow chart illustrating the fourth variation of the set snooze criteria action, indicated in FIG. 2
Figure 3E:
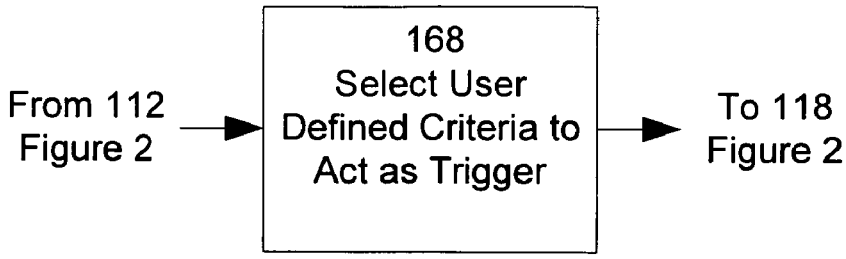
FIG. 3(E) is a flow chart illustrating the fifth variation of the set snooze criteria action, indicated in FIG. 2

The many variations of set snooze criteria 116 are illustrated in FIGS. 3(A)-3(I). In FIG. 3(A), the set snooze criteria 116 comprises the select snooze duration based on time 160 action, wherein the alarm is snoozed based on a fixed period of time selected either manually or by a computational device. In FIG. 3(B), this action is replaced by the select snooze duration based on abnormal event frequency 162, wherein the alarm is snoozed based on a fixed occurrence rate selected either manually or by a computational device. Alternatively, the set snooze criteria 116 can be replaced by select parameter(s) to monitor and rule(s) to establish severity limits 164 (FIG. 3(C)), select events to act as triggers 166 (FIG. 3(D)), or select user defined criteria to act as trigger 168 (FIG. 3(E)). In step 164, the alarm is snoozed based on the component, sub-system, or system health. An example of a component is a fuel pump, a sub-system may be fuel delivery system, and an example of a system is an engine. A system is defined as a group of related components that interact to perform a task. A subsystem can be defined as follows: A unit or device that is part of a larger system. For example, a disk subsystem is a part of the computer system. The bus is a part of the computer. A subsystem usually refers to hardware, but it may be used to describe software. A component can be defined as an element of a larger system. A hardware component can be a device as small as a transistor or as large as a disk drive as long as it is part of a larger system. Thresholds are defined by upper limits, lower limits, and rate of change limitations for individual sensors, multiple sensors, OEM monitoring systems, or other predictive maintenance systems, established either by an analyst or by a computational device.

The select event to act as trigger 166 step snoozes an alarm based on the occurrence of one or more events. One or more operational, administrative, and maintenance actions can be selected as triggers for the release of the snooze, selected by either an analyst or a computational device. Administrative events are those related to management of people or facilities.

For example, the maintenance shop or wash bay becomes available or a specific skilled maintenance technician starts work. Maintenance events are related to the execution of the maintenance process. The select user defined criteria to act as trigger 168 step snoozes an alarm based on user established criteria. This user-established criteria may include production/operation/logistics based factors (i.e. number of gallons of fuel consumed, material moved, operational cycles completed, distance traveled, operating hours, work performed, etcetera).

Figure 3F:
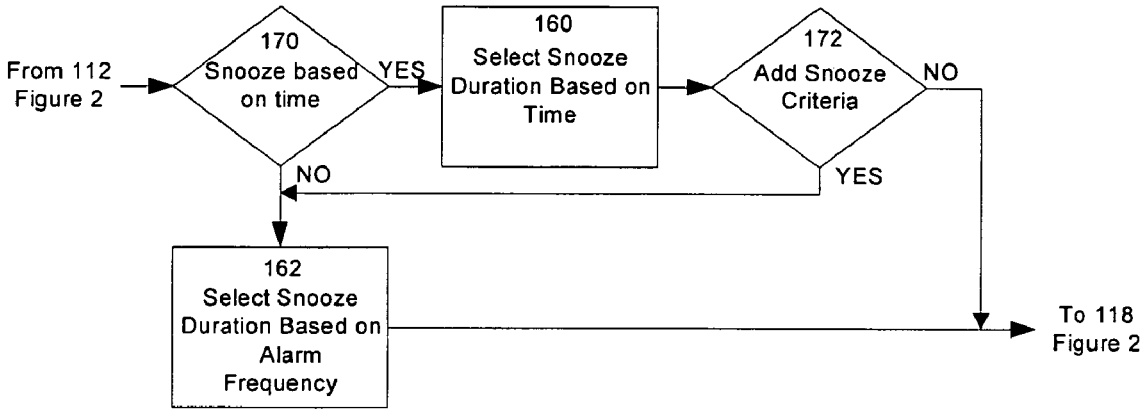
FIG. 3(F) is a flow chart illustrating the sixth variation of the set snooze criteria action, indicated in FIG. 2
Figure 3:
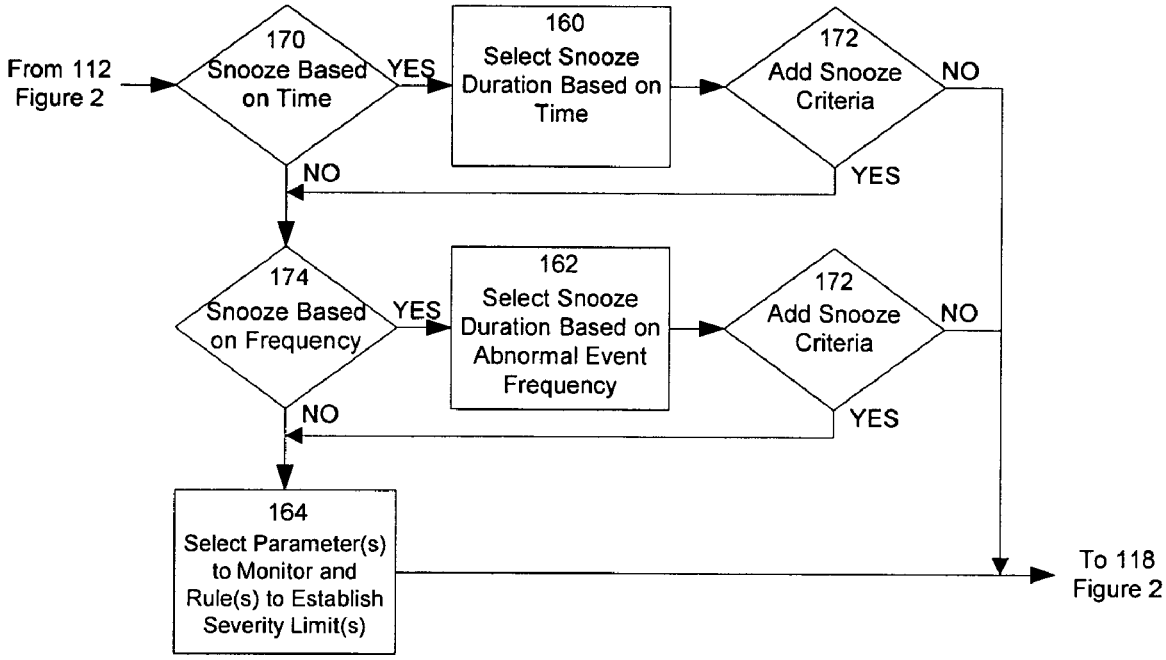
FIG. 3(G) is a flow chart illustrating the seventh variation of the set snooze criteria action, indicated in FIG. 2
FIG. 3(H) is a flow chart illustrating the eighth variation of the set snooze criteria action, indicated in FIG. 2
FIG. 3(I) is a flow chart illustrating the ninth variation of the set snooze criteria action, indicated in FIG. 2

FIG. 3(F) introduces step snooze based on time 170 and add snooze criteria 172 decision points. In step 170, a logical operator evaluates whether the alarm meets established criteria based on time. If true, the algorithm proceeds to select snooze duration based on time 160, else it proceeds to step 162. Step 172 utilizes a logical operator to evaluate whether the alarm requires additional snooze criteria to complement any already selected.

Figure 3H:
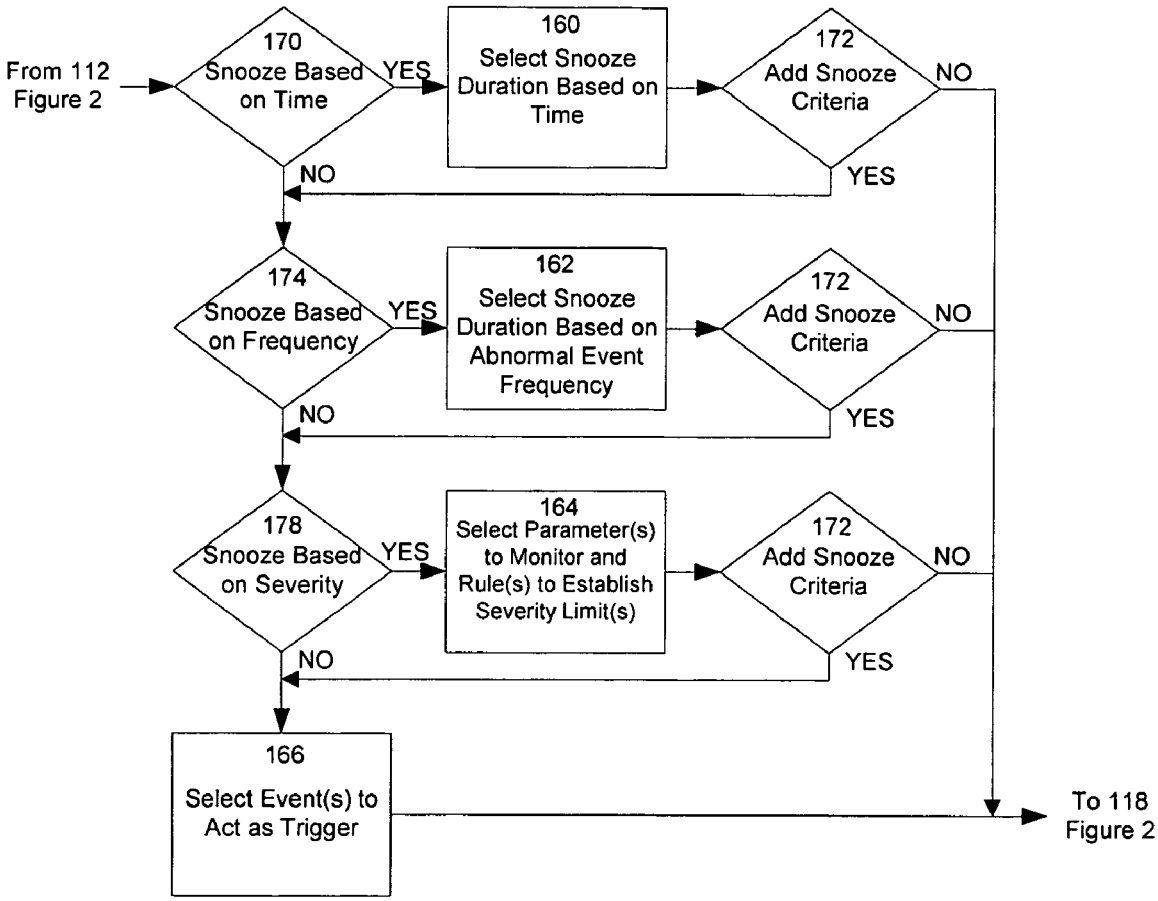
Figure 3I:
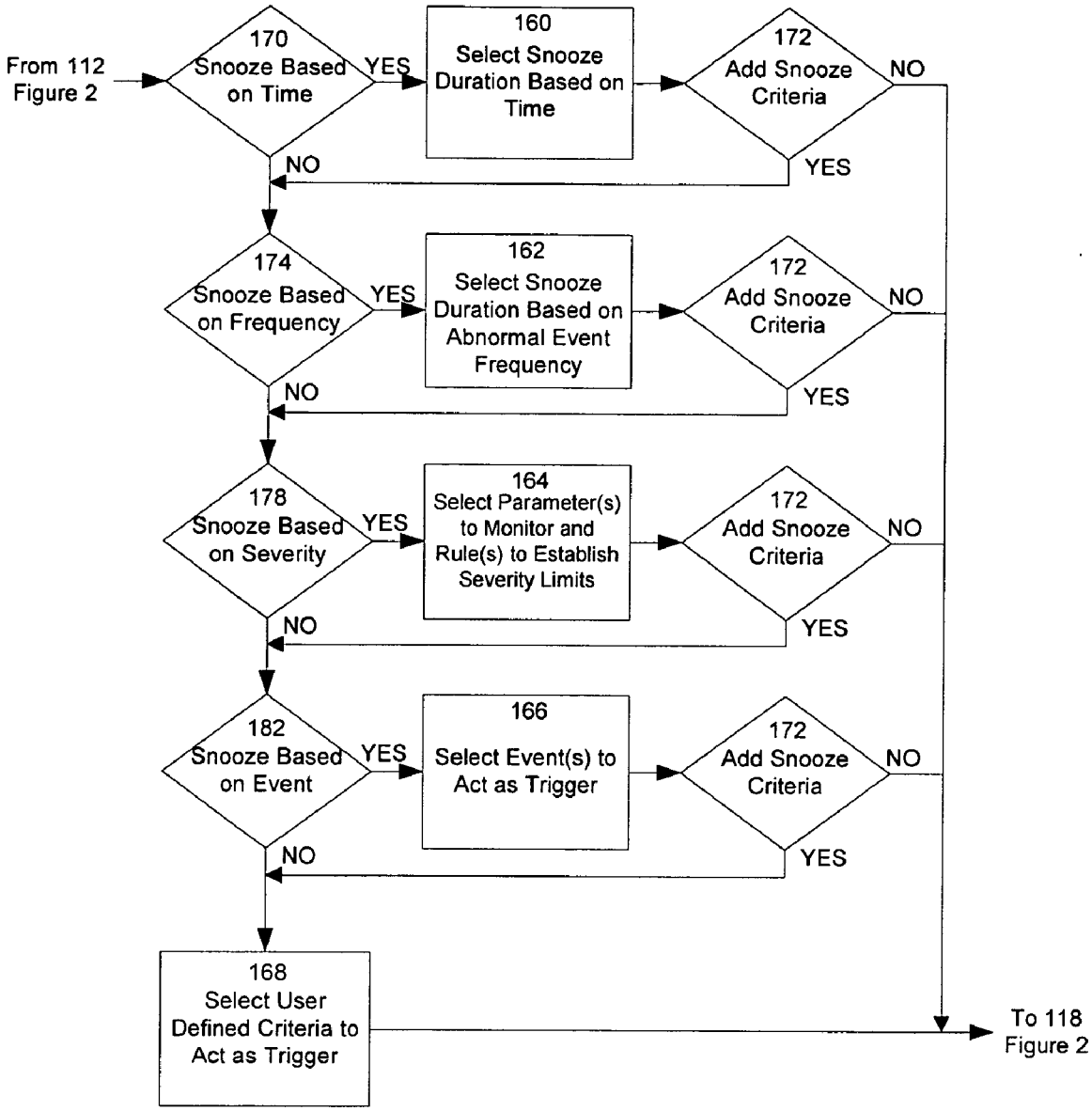
Figure 4A:
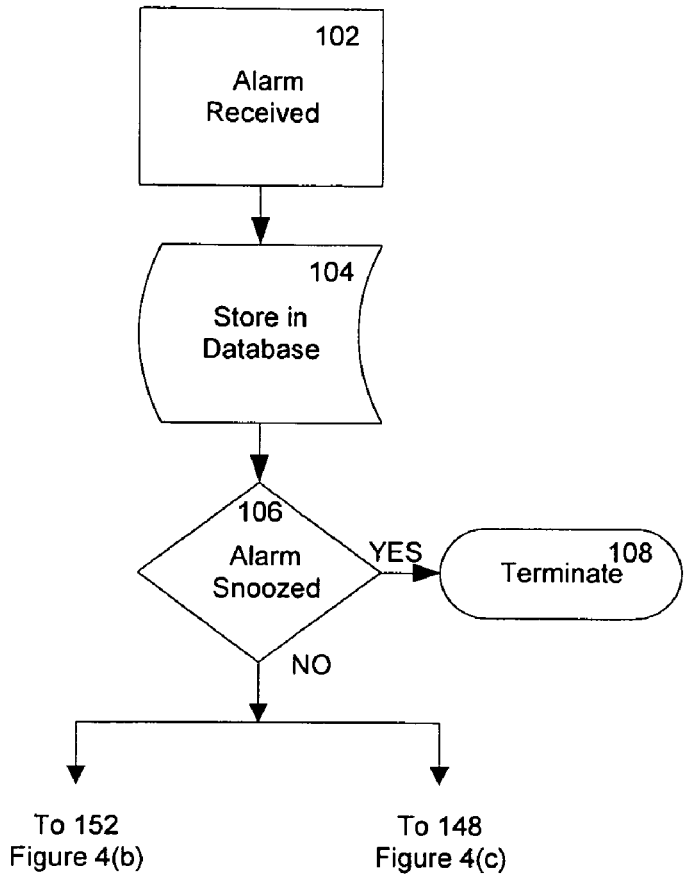
FIGS. 4(A)-4(F) are flowcharts illustrating a similar but alternate embodiment of the invention.
Figure 4B:
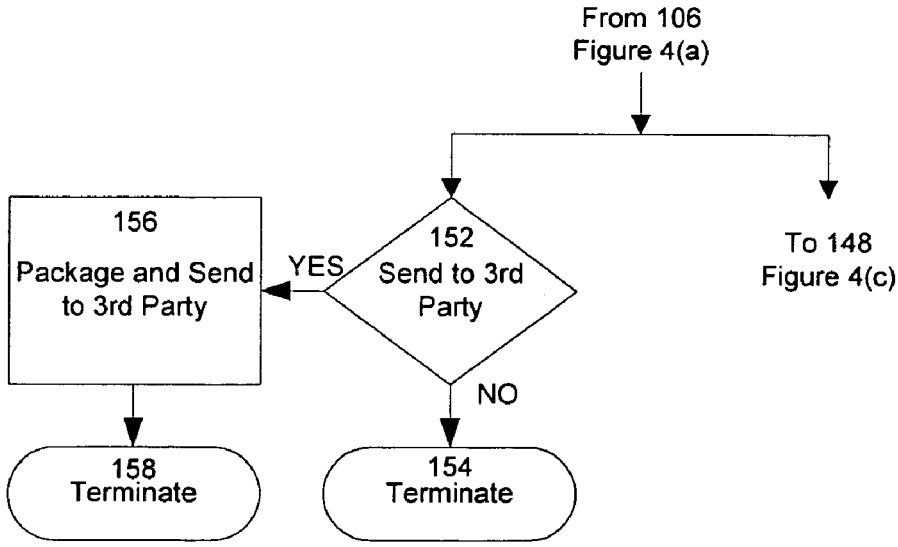
Figure 4C:
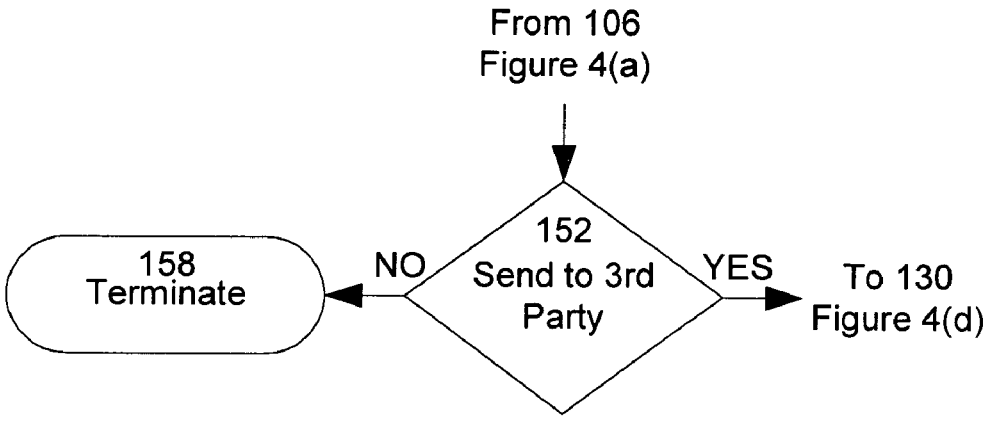
Figure 4D:
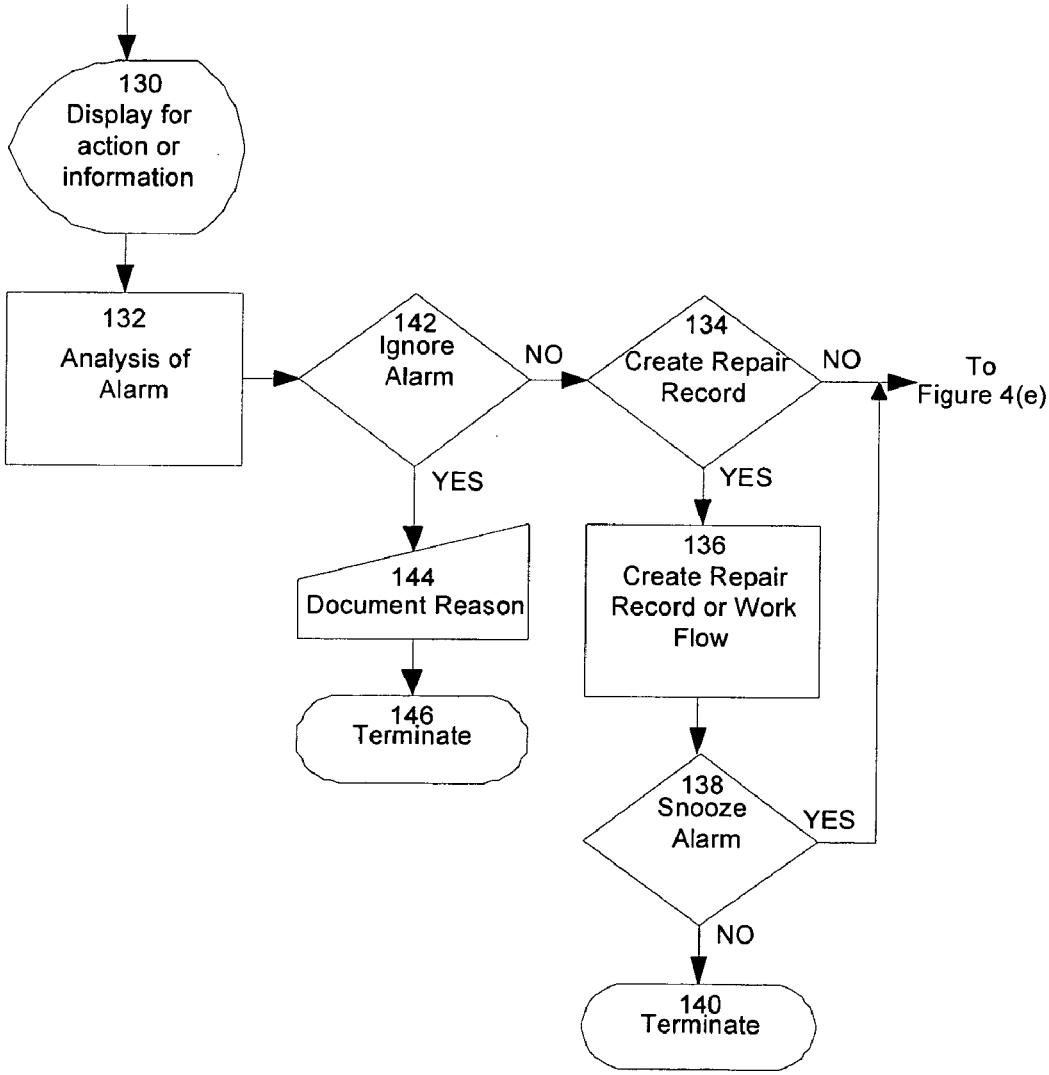
Figure 4E:
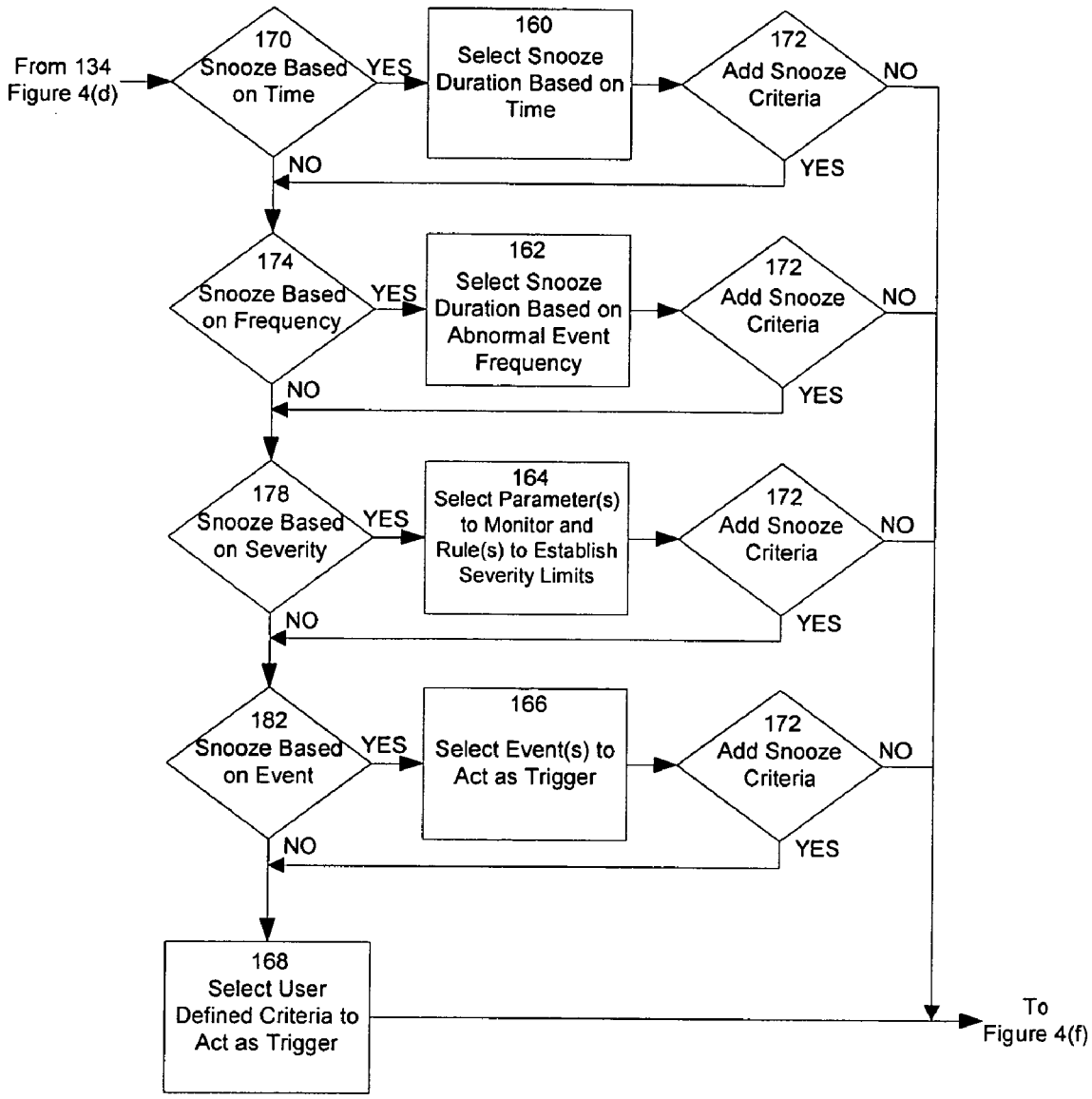
Figure 4F:
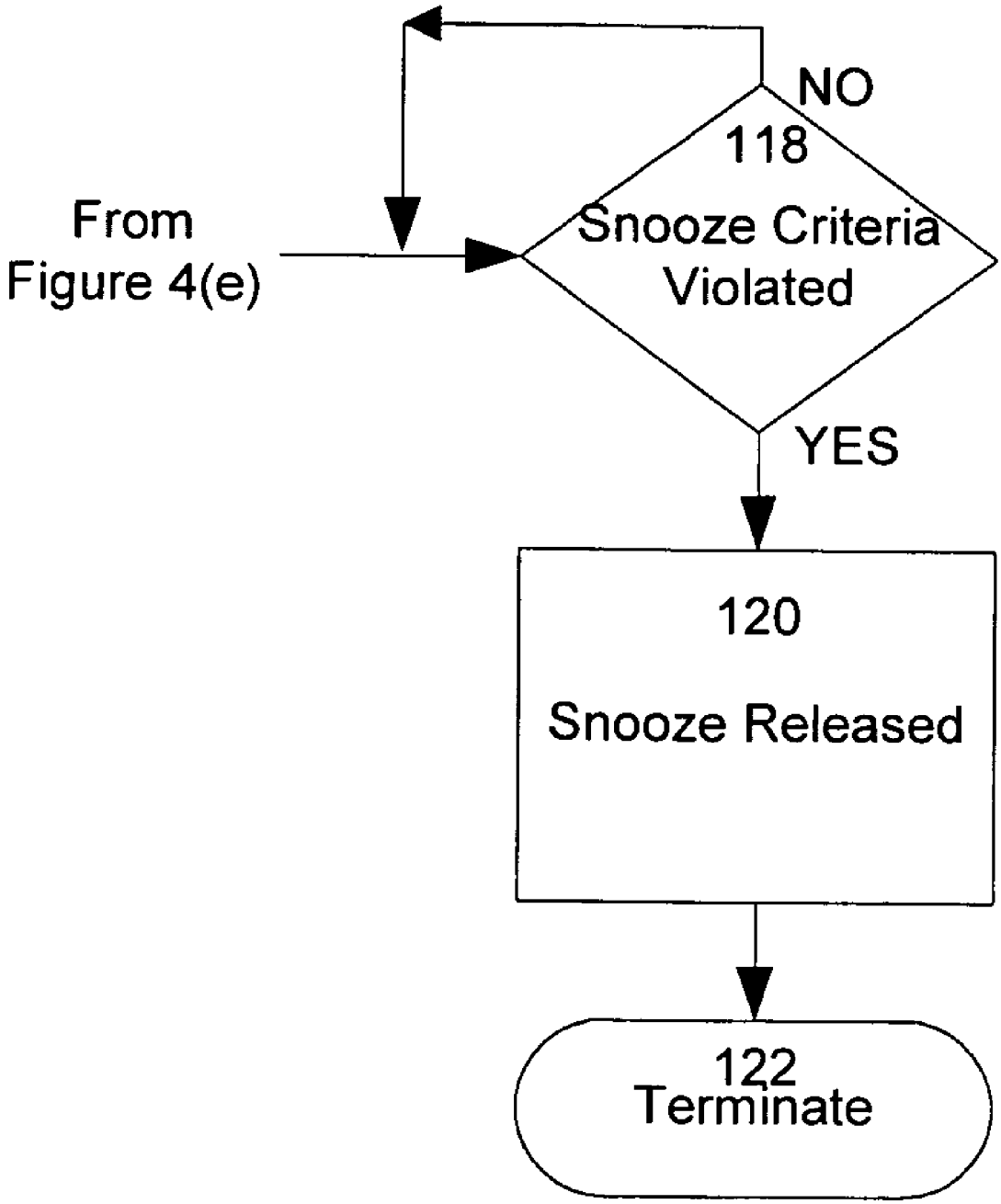

The algorithm of FIG. 3(G) is similar to that of FIG. 3(F), but introduces snooze based on frequency 174, which utilizes a logical operator to evaluate whether the alarm meets the criteria to be snoozed based on occurrence rate. FIG. 3(H) introduces snooze based on severity 178, wherein a logical operator evaluates whether the alarm meets the criteria to be snoozed based on the health status of a component, subsystem, or system. Finally, FIG. 3(I) introduces Snooze Based on Event 182, which uses a logical operator to evaluate whether the alarm meets the criteria to be snoozed based on the occurrence of a defined event. An event 182 is an action initiated either by the user or the computer. A similar but alternate embodiment of the invention is illustrated in the flow charts of FIGS. 4(A)-4(F).

Others skilled in the art of handling alarms may develop other embodiments of the present invention. The embodiments described herein are but a few of the modes of the invention. Therefore, the terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

I claim:

1. A method of handling equipment failure alarms comprising the steps of:

receiving an alarm from a transceiver coupled to a heavy vehicle, the heavy vehicle including at least one of a dozer, drill, haul truck, loader and shovel, said alarm indicating a state of at least one of a component and a system of the heavy vehicle, the state being defined by at least one of an alarm generator located on the at least one of a component and a system, an excavation record, a dump record, and an equipment status time, the alarm including an abnormal event identifier and at least one of an equipment identifier, a location, and an equipment operator identification;

storing the received alarm in a database;

evaluating whether a notification of the received alarm should be sent to a third party maintenance organization;

when notification of the received alarm should be sent to a third party maintenance organization, sending an alarm packet describing the received alarm to the third party maintenance organization;

determining that the alarm has not been snoozed by examining a status identifier of the alarm, wherein said status identifier indicates whether an alarm notification is temporarily suppressed;

analyzing the alarm, by:

identifying a minimum health factor for at least one of the component and system of the heavy vehicle, identifying an occurrence frequency of the alarm, determining whether the minimum health factor for the at least one of the component and system of the heavy vehicle has been violated, and using the determination of whether the minimum health factor has been violated and the occurrence frequency of the alarm to determine whether the alarm is to be snoozed; and when the alarm is not to be snoozed, displaying the alarm for action or information.

2. A method of handling equipment failure alarms comprising the steps of:

receiving an alarm from a transceiver coupled to a heavy vehicle, said alarm indicating a state of at least one of a component and a system of the heavy vehicle, the state being defined by at least one of an alarm generator located on the at least one of a component and a system, an excavation record, a dump record, and an equipment status time, the alarm including an abnormal event identifier and at least one of an equipment identifier, a location, and an equipment operator identification;

storing the received alarm in a database;

determining that the alarm has not been snoozed by examining a status identifier of the alarm, wherein said status identifier indicates whether an alarm notification is temporarily suppressed;

analyzing the alarm, by:

determining an availability of a maintenance facility to repair the at least one of a component and a system of the heavy vehicle, identifying a minimum health factor for at least one of the component and system of the heavy vehicle, and using the minimum health factor and the availability of the maintenance facility to determine whether the alarm is to be snoozed;

when the alarm is to be snoozed, setting snooze criteria based upon the availability of the maintenance facility; and when the maintenance facility is available, releasing the alarm.

3. The method of claim 2, further comprising the step of displaying the alarm for action or information, wherein said displaying step follows the step of determining that the alarm has not been snoozed and precedes the step of analyzing the alarm.

4. The method of claim 3, including:

identifying a consequence based upon the abnormal event identifier;

determining whether a repair record is to be created using the consequence;

when a repair is to be created, creating a repair record; and snoozing the alarm, wherein said steps of determining that a repair record is to be created and creating a repair record follow analyzing the alarm and precede the step of snoozing the alarm.

5. The method of claim 4, further comprising the step of determining that said alarm is not to be ignored, wherein said determining that said alarm is not to be ignored step follows the analyzing the alarm step and precedes the snoozing the alarm step.

6. The method of claim 5, further comprising the step of sending the alarm to an analyst, wherein said sending step follows the step of determining that the alarm has not been snoozed and precedes the step of determining that said alarm is not to be ignored.

7. The method of claim 6, further comprising the steps of:

determining that the alarm is to be sent to a third-party; and sending said alarm to said third-party; wherein said determining that the alarm is to be sent to a third-party step follows the step of determining that the alarm has not been snoozed.

8. The method of claim 4, further comprising the steps of: ignoring said alarm; and documenting the reason for ignoring said alarm, wherein said ignoring step and said documenting steps follow the analyzing the alarm step and precedes the snoozing the alarm step.

9. The method of claim 8, further comprising the step of sending the alarm to an analyst, wherein said sending step follows the step of determining that the alarm has not been snoozed and precedes the step of ignoring said alarm.

10. The method of claim 9, further comprising the steps of:

determining that the alarm is to be sent to a third-party; and sending said alarm to said third-party; wherein said determining that the alarm is to be sent to a third-party step follows the step of determining that the alarm has not been snoozed.

11. The method of claim 4, further comprising the step of sending the alarm to an analyst, wherein said sending step follows said determining that the alarm has not been snoozed and precedes the step of displaying the alarm for action or information.

12. The method of claim 11, further comprising the steps of:

determining that the alarm is to be sent to a third-party; and sending said alarm to a third-party; wherein said determining that the alarm is to be sent to a third-party step follows the step of determining that the alarm has not been snoozed.

13. The method of claim 2, wherein the step of setting snooze criteria comprises selecting snooze duration based on a predetermined time value, wherein said selecting snooze duration step follows said determining that the alarm is to be snoozed step and precedes the step of determining that at least one of the snooze criteria has been violated, and wherein the step of determining that at least one of the snooze criteria has been violated comprises determining that said predetermined time value has been exceeded.

14. The method of claim 2, further comprising the step of selecting parameters to monitor and rules to establish severity limits, wherein said selecting parameters and rules step follows said determining that the alarm is to be snoozed step and precedes the step of determining that at least one of the snooze criteria has been violated.

15. The method of claim 2, wherein the step of setting snooze criteria comprises selecting an event to act as a trigger, wherein said selecting event step follows said determining that the alarm is to be snoozed step and precedes the step of determining that at least one of the snooze criteria has been violated, and wherein the step of determining that at least one of the snooze criteria has been violated comprises determining that said event has occurred.

16. The method of claim 2, wherein the step of setting snooze criteria comprises selecting user defined criteria to act as a trigger, wherein said selecting user defined criteria step follows said determining that the abnormal event is to be snoozed step and precedes the step of determining that at least one of the snooze criteria has been violated, and wherein the step of determining that at least one of the snooze criteria has been violated comprises determining that said user defined criteria have been satisfied.

17. A method of handling equipment failure alarms comprising the steps of:

receiving an alarm from a transceiver coupled to a heavy vehicle, the heavy vehicle including at least one of a dozer, drill, haul truck, loader and shovel, said alarm indicating a state of at least one of a mechanical component and a mechanical system of the heavy vehicle, the state being defined by at least one of an alarm generator located on the at least one of a component and a system, an excavation record, a dump record, and an equipment status time, the alarm including an abnormal event identifier and at least one of an equipment identifier, a location, and an equipment operator identification;

storing the received alarm in a database;

determining that the alarm has not been snoozed by examining a status identifier of the alarm, wherein said status identifier indicates whether an alarm notification is temporarily suppressed;

analyzing the alarm, by:

identifying a minimum health factor for at least one of the component and system of the heavy vehicle, the minimum health factor being characterized by a predetermined rate of change of a health factor of the heavy vehicle, and determining whether the minimum health factor for the at least one of the mechanical component and mechanical system of the heavy vehicle has been violated to determine whether the alarm is to be snoozed;

when the alarm is not to be snoozed, displaying the alarm for action or information; and when the alarm is to be snoozed:

receiving a user-defined criteria to act as a trigger, the user defined criteria identifying a maintenance facility that is capable of repairing the at least one of a component and a system of the heavy vehicle, setting snooze criteria, the snooze criteria being based upon the user-defined criteria, determining whether the maintenance facility identified by the trigger is available, and when the maintenance facility is available, releasing the alarm.

* * * * *